US005234891A

United States Patent [19]

Burberry et al.

[11] Patent Number: 5,234,891

[45] Date of Patent: Aug. 10, 1993

[54] MIXTURE OF DYE-CONTAINING BEADS FOR LASER-INDUCED THERMAL DYE TRANSFER

[75] Inventors: Mitchell S. Burberry, Webster; John M. Noonan, Rochester; Danny R. Thompson, Fairport; Thomas A. Machell, Webster, all of N.Y.

[73] Assignee: Eastman Kodak Company, Rochester, N.Y.

[21] Appl. No.: 992,236

[22] Filed: Dec. 17, 1992

[51] Int. Cl.[5] ..... B41M 5/035; B41M 5/26

[52] U.S. Cl. ..... 503/227; 428/195; 428/327; 428/478.2; 428/508; 428/509; 428/510; 428/913; 428/914; 430/200; 430/201; 430/945

[58] Field of Search ..... 8/471; 428/195, 323, 428/327, 478.2, 508–510, 913, 914; 430/200, 201, 945; 503/227

[56] References Cited

U.S. PATENT DOCUMENTS 4,833,060 5/1989 Nair et al. ..... 430/137

FOREIGN PATENT DOCUMENTS

88/07450 10/1988 World Int. Prop. O. ..... 428/321.5

*Primary Examiner*—B. Hamilton Hess

*Attorney, Agent, or Firm*—Harold E. Cole

[57] ABSTRACT

This invention relates to a multicolor dye donor element for laser-induced thermal dye transfer comprising a support having thereon a single dye layer comprising a mixture of at least two different colors of solid, homogeneous beads, each of which contains an image dye, a binder and a laser light-absorbing material, the beads being dispersed in a vehicle, and the beads of each color being sensitized to a different wavelength.

18 Claims, No Drawings

MIXTURE OF DYE-CONTAINING BEADS FOR LASER-INDUCED THERMAL DYE TRANSFER

This invention relates to the use of certain multicolor dye-containing beads in the donor element of a laser-induced thermal dye transfer system.

In recent years, thermal transfer systems have been developed to obtain prints from pictures which have been generated electronically from a color video camera. According to one way of obtaining such prints, an electronic picture is first subjected to color separation by color filters. The respective color-separated images are then converted into electrical signals. These signals are then operated on to produce cyan, magenta and yellow electrical signals. These signals are then transmitted to a thermal printer. To obtain the print, a cyan, magenta or yellow dye-donor element is placed face-to-face with a dye-receiving element. The two are then inserted between a thermal printing head and a platen roller. A line-type thermal printing head is used to apply heat from the back of the dye-donor sheet. The thermal printing head has many heating elements and is heated up sequentially in response to the cyan, magenta or yellow signal. The process is then repeated for the other two colors. A color hard copy is thus obtained which corresponds to the original picture viewed on a screen. Further details of this process and an apparatus for carrying it out are contained in U.S. Pat. No. 4,621,271, the disclosure of which is hereby incorporated by reference.

Another way to thermally obtain a print using the electronic signals described above is to use a laser instead of a thermal printing head. In such a system, the donor sheet includes a material which strongly absorbs at the wavelength of the laser. When the donor is irradiated, this absorbing material converts light energy to thermal energy and transfers the heat to the dye in the immediate vicinity, thereby heating the dye to its vaporization temperature for transfer to the receiver. The absorbing material may be present in a layer beneath the dye and/or it may be admixed with the dye. The laser beam is modulated by electronic signals which are representative of the shape and color of the original image, so that each dye is heated to cause volatilization only in those areas in which its presence is required on the receiver to reconstruct the color of the original object. Further details of this process are found in GB 2,083,726A, the disclosure of which is hereby incorporated by reference.

A laser imaging system typically involves a donor element comprising a dye layer containing an infrared-absorbing material, such as an infrared-absorbing dye, and one or more image dyes in a binder.

PCT publication WO 88/07450 discloses an inking ribbon for laser thermal dye transfer comprising a support coated with microcapsules containing printing inks and laser light-absorbers. The microcapsules can contain yellow, magenta and cyan dye, each of which is associated with an infrared-absorbing dye at a different wavelength. The microcapsules are randomly mixed together forming a single coated layer on the dye-donor support. These microcapsules can be individually addressed by three lasers, each having a wavelength tuned to the peak of the infrared-absorbing dye and each corresponding to a given color record.

However, there are a number of problems associated with the use of microcapsules in dye-donors. Microcapsules have cell walls that encapsulate ink and associated volatile ink solvents which are typically low-boiling oils or hydrocarbons that can be partially vaporized during printing and evaporate readily on the receiver as the ink dries. The use of volatile solvents can cause health and environmental concerns. In addition, solvent in the microcapsules can dry out over time before printing and therefore lead to changes in sensitivity (i.e., poor dye-donor shelf life). Further, since microcapsules are pressure-sensitive, if they are crushed, ink and solvent can leak out. Still further, microcapsule cell walls burst when printed, releasing ink in an all-or-nothing manner, making them poorly suited for continuous tone applications.

In U.S. Pat. No. 4,833,060, a method is disclosed for making polymeric particles by mixing an oil phase which contains organic components, under high shear conditions, in water with stabilizer and promoter to form an emulsion having a well-defined droplet size distribution. The solvent in the oil phase is then distilled off leaving the solid particles dispersed in water. There is no disclosure in this patent, however, of using this technique to make a dye-donor element for a laser-induced thermal dye transfer system.

It is an object of this invention to provide a multicolor dye-donor element for a laser-induced thermal dye transfer system which avoids the problems noted above with using microcapsules. It is another object of this invention to provide a multicolor dye-donor element whereby a multicolor transfer print can be obtained with only one pass through a laser print engine containing three lasers.

These and other objects are achieved in accordance with this invention which relates to a multicolor dye donor element for laser-induced thermal dye transfer comprising a support having thereon a single dye layer comprising a mixture of at least two different colors of solid, homogeneous beads, each of which contains an image dye, a binder and a laser light-absorbing material, the beads being dispersed in a vehicle, and the beads of each color being sensitized to a different wavelength.

The beads which contain the image dye, binder and laser light-absorbing material can be made by the process disclosed in U.S. Pat. No. 4,833,060 discussed above, the disclosure of which is hereby incorporated by reference. The beads are described as being obtained by a technique called "evaporated limited coalescence."

The binders which may be employed in the solid, homogeneous beads of the invention which are mixed with the image dye and laser light-absorbing material include materials such as cellulose acetate propionate, cellulose acetate butyrate, polyvinyl butyral, nitrocellulose, poly(styrene-co-butyl acrylate), polycarbonates such as Bisphenol A polycarbonate, poly(styrene-co-vinylphenol) and polyesters. In a preferred embodiment of the invention, the binder in the beads is cellulose acetate propionate or nitrocellulose. While any amount of binder may be employed in the beads which is effective for the intended purpose, good results have been obtained using amounts of up to about 50% by weight based on the total weight of the bead.

The vehicle in which the beads are dispersed to form the dye layer of the invention includes water-compatible materials such as poly(vinyl alcohol), pullulan, polyvinylpyrrolidone, gelatin, xanthan gum, latex polymers and acrylic polymers. In a preferred embodiment of the invention, the vehicle used to disperse the beads is gelatin.

The beads are approximately 0.1 to about 20 μm in size, preferably about 1 μm. The beads can be employed at any concentration effective for the intended purpose. In general, the beads can be employed in a concentration of about 40 to about 90% by weight, based on the total coating weight of the bead-vehicle mixture.

Use of the invention provides a completely dry printing system that utilizes a random mixture of small, solid beads in a single layer to print images having excellent print density at relatively high printing speed and low laser power. This system is also capable of printing different colors from a single pass since the different colored beads are individually addressed by two or more lasers each having a wavelength tuned near the peak of the laser light-absorbing dye, i.e., 780 nm for the laser light-absorbing dye in the cyan beads, 875 nm for the laser light-absorbing dye in the magenta beads and 980 nm for the laser light-absorbing dye in the yellow beads.

There are numerous advantages in making a multicolor image by printing with only one single pass dye-donor. Replacing two or more donors with only one donor results in less wasted support, fewer manufacturing steps, simpler finishing, simpler media handling in the printer, simpler quality assurance procedures and faster printing.

Spacer beads are normally employed in a laser-induced thermal dye transfer system to prevent sticking of the dye-donor to the receiver. By use of this invention however, spacer beads are not needed, which is an added benefit.

To obtain the laser-induced thermal dye transfer image employed in the invention, diode lasers are preferably employed since they offer substantial advantages in terms of small size, low cost, stability, reliability, ruggedness, and ease of modulation. In practice, before any laser can be used to heat a dye-donor element, the element must contain a laser light-absorbing material, such as carbon black or cyanine infrared-absorbing dyes as described in U.S. Pat. No. 4,973,572, or other materials as described in the following U.S. Pat. Nos.: 4,948,777, 4,950,640, 4,950,639, 4,948,776, 4,948,778, 4,942,141, 4,952,552, 5,036,040, and 4,912,083, the disclosures of which are hereby incorporated by reference. The laser light-absorbing material can be employed at any concentration effective for the intended purpose. In general, good results have been obtained at a concentration of about to about 25% by weight, based on the total weight of the bead. The laser radiation is then absorbed into the dye layer and converted to heat by a molecular process known as internal conversion. Thus, the construction of a useful dye layer will depend not only on the hue, transferability and intensity of the image dyes, but also on the ability of the dye layer to absorb the radiation and convert it to heat. As noted above, the laser light-absorbing material is contained in the beads coated on the donor support.

Lasers which can be used to transfer dye from dye-donors employed in the invention are available commercially. There can be employed, for example, Laser Model SDL-2420-H2 from Spectra Diode Labs, or Laser Model SLD 304 V/W from Sony Corp.

A thermal printer which uses a laser as described above to form an image on a thermal print medium is described and claimed in copending U.S. application Ser. No. 451,656 of Baek and DeBoer, filed Dec. 18, 1989, the disclosure of which is hereby incorporated by reference.

Any image dye can be used in the beads of the dye-donor employed in the invention provided it is transferable to the dye-receiving layer by the action of the laser. As noted above, a mixture of beads employing at least two different colors is used in order to give a multicolor transfer. In a preferred embodiment, cyan, magenta and yellow dyes are used in the beads. Especially good results have been obtained with sublimable dyes such as anthraquinone dyes, e.g., Sumikalon Violet RS® (product of Sumitomo Chemical Co., Ltd.), Dianix Fast Violet 3R-FS® (product of Mitsubishi Chemical Industries, Ltd.), and Kayalon Polyol Brilliant Blue N-BGM® and KST Black 146® (products of Nippon Kayaku Co., Ltd.); azo dyes such as Kayalon Polyol Brilliant Blue BM®, Kayalon Polyol Dark Blue 2BM®, and KST Black KR® (products of Nippon Kayaku Co., Ltd.), Sumickaron Diazo Black 5G® (product of Sumitomo Chemical Co., Ltd.), and Miktazol Black 5GH® (product of Mitsui Toatsu Chemicals, Inc.); direct dyes such as Direct Dark Green B® (product of Mitsubishi Chemical Industries, Ltd.) and Direct Brown M® and Direct Fast Black D® (products of Nippon Kayaku Co. Ltd.); acid dyes such as Kayanol Milling Cyanine 5R® (product of Nippon Kayaku Co. Ltd.); basic dyes such as Sumicacryl Blue 6G® (product of Sumitomo Chemical Co., Ltd.), and Aizen Malachite Green® (product of Hodogaya Chemical Co., Ltd.);

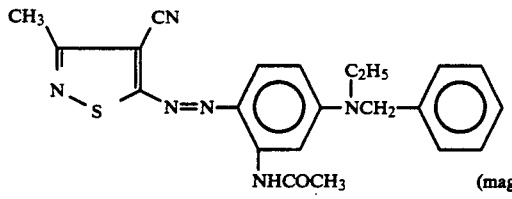

(magenta)

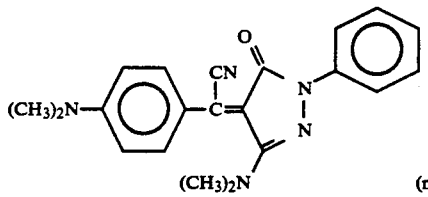

(magenta)

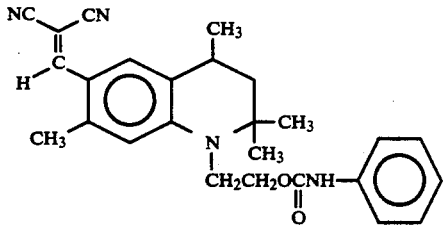

(yellow)

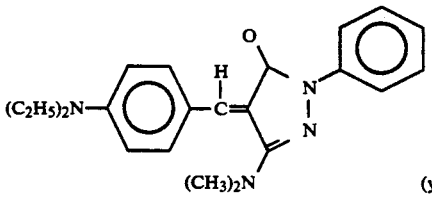

(yellow)

-continued

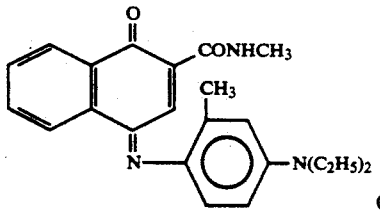

(cyan)

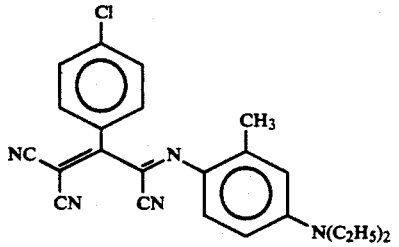

(cyan)

or any of the dyes disclosed in U.S. Pat. Nos. 4,541,830, 4,698,651, 4,695,287, 4,701,439, 4,757,046, 4,743,582, 4,769,360, and 4,753,922, the disclosures of which are hereby incorporated by reference. The above dyes may be employed singly or in combination. The image dye may be employed in the bead in any amount effective for the intended purpose. In general, good results have been obtained at a concentration of about 40 to about 90% by weight, based on the total weight of the bead.

Any material can be used as the support for the dye-donor element employed in the invention provided it is dimensionally stable and can withstand the heat of the laser. Such materials include polyesters such as poly(ethylene terephthalate); polyamides; polycarbonates; cellulose esters such as cellulose acetate; fluorine polymers such as poly(vinylidene fluoride) or poly(tetrafluoroethylene-co-hexafluoropropylene); polyethers such as polyoxymethylene; polyacetals; polyolefins such as polystyrene, polyethylene, polypropylene or methylpentene polymers; and polyimides such as polyimide-amides and polyether-imides. The support generally has a thickness of from about 5 to about 200 μm. It may also be coated with a subbing layer, if desired, such as those materials described in U.S. Pat. Nos. 4,695,288 or 4,737,486.

The dye-receiving element that is used with the dye-donor element employed in the invention usually comprises a support having thereon a dye image-receiving layer or may comprise a support made out of dye image-receiving material itself. The support may be glass or a transparent film such as a poly(ether sulfone), a polyimide, a cellulose ester such as cellulose acetate, a poly(vinyl alcohol-co-acetal) or a poly(ethylene terephthalate). The support for the dye-receiving element may also be reflective such as baryta-coated paper, white polyester (polyester with white pigment incorporated therein), an ivory paper, a condenser paper or a synthetic paper such as DuPont Tyvek ®.

The dye image-receiving layer may comprise, for example, a polycarbonate, a polyester, cellulose esters, poly(styrene-co-acrylonitrile), polycaprolactone or mixtures thereof. The dye image-receiving layer may be present in any amount which is effective for the intended purpose. In general, good results have been obtained at a concentration of from about 1 to about 5 $g/m^2$.

A process of forming a multicolor laserinduced thermal dye transfer image according to the invention comprises:

a) contacting at least one multicolor dye-donor element as described above, with a dye-receiving element comprising a support having thereon a polymeric dye image-receiving layer;

b) imagewise-heating the dye-donor element by means of a laser; and c) transferring a dye image to the dye-receiving element to form the multicolor laser-induced thermal dye transfer image.

The following examples are provided to illustrate the invention.

PREPARATION OF BEAD DISPERSIONS

A combination of a polymeric binder as described below, image dye, and laser light-absorbing dye were dissolved in dichloromethane (or methylisopropyl ketone where indicated). A mixture of 30 ml of Ludox ® $SiO_2$ (DuPont) and 3.3 ml of AMAE (a copolymer of methylaminoethanol and adipic acid) (Eastman Kodak Co.) was added to 1000 ml of phthalic acid buffer (pH 4). The organic and aqueous phases were mixed together under high shear conditions using a microfluidizer. The organic solvent was then distilled from the resulting emulsion by bubbling dry $N_2$ through the emulsion or by distillation using a rotavaporizer. This procedure resulted in an aqueous dispersion of solid beads in a water phase which was coarse-filtered followed by diafiltration, and the particles were isolated by centrifugation. The isolated wet particles were put into distilled water at a concentration of approximately 15 wt. %.

COATING PREPARATIONS

E-1-Magneta (IR-1) + yellow coating

A magenta bead dispersion was prepared from 13.0 g cellulose acetate propionate (CAP) 482-20 (Tennessee Eastman Company), 13.0 g each of the magenta dyes illustrated above, and 6.0 g IR-absorbing dye IR-1 illustrated below, according to the general procedure for the bead preparation outlined above.

Similarly prepared was a yellow bead dispersion from 13.0 g CAP, 20.8 g of the first yellow dye illustrated above and 5.2 g of the second yellow dye illustrated above.

A magenta (IR-1) +yellow test coating was prepared by combining 1.34 g gelatin (12.5%) (Type IV deionized), 1.09 g of the above magenta bead dispersion (15.35%), 0.908 g of the yellow bead dispersion (18.39%), 0.46 g of a 10% solution of Dowfax 2Al ® surfactant (Dow Chemical Co.) and 17.11 g water. This coating was applied to a gelatin-subbed 100 μm poly(ethylene terephthalate) support at 40° C., using a 50 μm coating knife.

In the above case, the laser light-absorbing dye had been incorporated in the magenta bead dispersion, hence this coating is identified as magenta (IR-1) +yellow coating. Similarly prepared were the various other coatings, as shown below.

E-2-Yellow (IR-1) +magenta coating

A magenta bead dispersion was prepared as in E-1 without the laser light-absorbing dye. A yellow bead dispersion was prepared as in E-1 except that 6.0 g IR-1 illustrated below was added. The coating was made up by combining 1.34 g gelatin (12.5%), 1.234 g of the above magenta bead dispersion (13.51%), 1.156 g of the above yellow bead dispersion (14.42%), 0.46 g of a solution of Dowfax ® 2Al surfactant and 15.85 g water. The coating was applied as in E-1.

E-3-Magenta (IR-1) coating

This coating was prepared from gelatin (12.5%) (0.67 g), 1.09 g of the magenta bead dispersion (15.35%) of E-1, 0.23 g of a 10% solution of Dowfax 2Al ® surfactant and 8.01 g water. This coating was then applied as in E-1.

E-5-Yellow (IR-1) +cyan coating

This coating was made from 0.67 g gelatin (12.5%), 1.156 g of the yellow bead dispersion (14.42%) of E-2, 0.23 g of a 10% solution of Dowfax 2Al ® surfactant, and 7.44 g water. The coating was applied as in E-1.

E-5-Yellow (IR-1) +cyan coating

A cyan bead dispersion was prepared from 13.0 g CAP and 13.0 g each of the cyan dyes illustrated above. The test coating was made from 1.34 g gelatin (12.5%), 1.156 g yellow bead dispersion of E-2 (14.42%), 2.25 g of the above cyan bead dispersion (7.42%), 0.46 g of a 10% solution of Dowfax 2Al ®surfactant, and 14.834 g water. The coating was applied as in E-1.

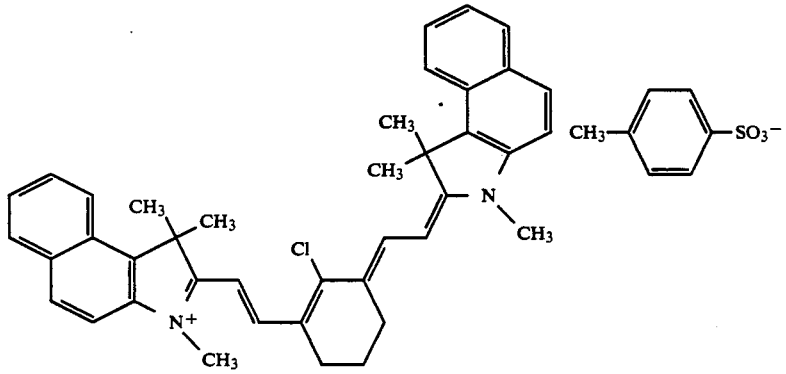

IR-Absorbing Dye IR-1

E-6-Magenta (IR-1) +cyan coating

This coating was made from. 1.34 g gelatin (12.5%), 1.09 g of the magenta bead dispersion of E-3, 2.25 g of the cyan bead dispersion of E-5 (7.42%), 0.46 g of a 10% solution of Dowfax 2Al ® surfactant and 14.90 g water. The coating was then applied as in E-1.

E-7-Cyan (IR-1) +yellow coating

A cyan bead dispersion was prepared as in E-5 except that 6.0 g IR-1 illustrated below was added. The coating was obtained by mixing 1.34 g gelatin (12.5%), 1.156 g of the yellow bead dispersion (18.39%) of E-1, 1.33 g of the above cyan bead dispersion (12.57%), 0.46 g of a 10% solution of Dowfax 2Al ® surfactant and 15.754 g distilled water. This coating was applied as in E-1.

E-8-Cyan (IR-1) +magenta coating

This coating was prepared from 1.34 g gelatin (12.5%), 1.234 g of the magenta bead dispersion (13.51%) of E-2, 1.33 g of the cyan bead dispersion (12.57%) of E-7, 0.46 g of a 10% solution of Dowfax 2Al ® surfactant and 15.676 g water. The coating was applied as in E-1.

E-9-Cyan (IR-1) coating

This coating was prepared from 1.33 g of the cyan bead dispersion of E-7, 0.67 g gelatin (12.5%), 0.23 g of a 10% solution of Dowfax 2Al ® surfactant and 7.77 g water. The coating was applied as in E-1.

E-10-Cyan +magenta (IR-1) +yellow coating

A cyan bead dispersion was prepared from 13.0 g CAP and 26 g of the second cyan dye illustrated above. The coating was made from 2.25 g gelatin (12.5%), 2.19 g of the yellow bead dispersion (8.6%) of E-1, 3.62 g of the magenta bead dispersion (10.4%) of E-1, 5.22 g of the above cyan bead dispersion (7.2%), 0.46 g of a 10% solution of Dowfax 2Al ® surfactant and 6.26 g water. The coating was applied as in E-1.

E-11-Cyan +magenta +yellow (IR-1) coating

This coating was prepared from 2.25 g gelatin (12%), 1.39 g of the yellow bead dispersion (13.5%) of E-2, 4.40 g of the magenta bead dispersion (8.54%) of E-2, 5.22 g of the cyan bead dispersion (7.2%) of E-10, 0.46 g of a 10% solution of Dowfax 2Al ® surfactant and 6.26 g water. The coating was applied as in E-1.

PRINT ENGINES

Experiments were conducted on two breadboard laser printers. One used a spinning drum to scan a beam from a laser-diode/fiberoptic source across the media assembly. A second print engine utilized a galvanic mirror to scan a Gaussian laser beam across a dye-donor/dye-receiver assembly, held on a flat bed with vacuum applied between the dye-donor and dye-receiver sheets.

Receiver for Drum Print Engine

An intermediate dye-receiving element was prepared by coating on an unsubbed 100 μm thick poly(ethylene terephthalate) support a layer of crosslinked poly(styrene-co-divinylbenzene) beads (14 micron average diameter) (0.11 g/m2), triethanolamine (0.09 g/m$^2$) and DC-510 ® Silicone Fluid (Dow Corning Company) (0.01 g/m$^2$) in a Butvar ® 76 binder, a poly(vinyl alcohol-co-butyral), (Monsanto Company) (4.0 g/m$^2$) from 1,1,2-trichloroethane or dichloromethane.

Drum Print Engine Operation

The assemblage of dye-donor and dye-receiver was scanned by a focused laser beam on a rotating drum, 31.2 cm in circumference, turning at either 350, 450, or 550 rev/min, corresponding to line writing speeds of 173, 222, or 271 cm/sec, respectively. A Spectra Diode Labs Laser Model SDL-2430-H2 was used and was rated at 250 mW, at 816 nm. The measured power and spot size at the donor surface was 115 mW and 33 μm ($1/e^2$), respectively. Power was varied from maximum to minimum values in 11 step patches of fixed power increments. The laser spot was stepped with a 14 μm center-to-center line pitch corresponding to 714 lines/cm or 1814 lines/in.

After the laser had scanned approximately 12 mm, the laser exposing device was stopped and the intermediate receiver was separated from the dye donor. The intermediate receiver containing the stepped dye image was laminated to Ad-Proof Paper ® (Appleton Papers, Inc.) 60 pound stock paper by passage through a pair of rubber rollers heated to 120° C. The polyethylene terephthalate support was then peeled away leaving the dye image and polyvinyl alcohol-co-butyral firmly adhered to the paper.

Flat Bed Print Engine

A Hitachi model HC8351E diode laser (rated at 50 mW, at 830 nm) was collimated and focussed to an elliptical spot on the dye-donor sheet approximately 13 μm ($1/e^2$) in the page direction and 14 μm ($1/e^2$) in the fast scan direction. The galvanometer scan rate was typically 70 cm/sec and the measured maximum power at the dye-donor was 37 mW, corresponding to an exposure of approximately 0.5 J/cm$^2$. Power was varied from this maximum to a minimum value in 16 step patches of fixed power increments. Experiments (summarized in Table IV below) were also run using 633 nm radiation from a Spectra-Physics Stabilite ® Model 1248 HeNe laser providing 17 mW at the donor and scanned at 70 cm/sec. Spacing between line scans in the page direction was typically 10 μm center-to-center corresponding to 1000 lines/cm or 2540 lines/in. Prints were made to either a resin-coated paper support or a transparent receiver and fused in acetone vapors at room temperature for 7 minutes. The transparent receiver was prepared from flat samples (1.5 mm thick) of Ektar ® DA003 (Eastman Kodak), a mixture of bisphenol A polycarbonate and poly (1,4-cyclohexylene dimethylene terephthalate) (50:50 mole ratio).

Three Laser Print Engine

In experiments where different IR laser wavelengths were required, the assemblage of dye-donor and dye-receiver was printed with a three laser lathe type printer having the characteristics indicated below. A drum, 41 cm in circumference was typically rotated at 150 rev/min, corresponding to scan speeds of 103 cm/sec. Maximum power available at the dye-donor was 30 mW at 781 nm (from a Hitachi model HL-7851G diode laser), 30 mW at 875 nm (from a Sanyo model SDL-6033-101 diode laser) and 64 mW at 980 nm (from a Spectro Diode model SDL-6310-GI diode laser). The focussed elliptical laser spot sizes, as measured at the $1/e^2$ intensity along the primary axes, were approximately 10.0 ×10.4 μm at 781 nm, 11.2 ×10.4 μm at 875 nm, and 14.0 ×11.6 μm at 980 nm. The lasers can be controlled such that only one laser is on at a time or any combination is on simultaneously. In the experiment described below, and in Table V, the test prints were made with only one laser on at a time. The drum was translated in the page scan direction at 10 μm center-to-center line pitch corresponding to 1000 lines/cm or 2540 lines/in. A 16 step image was printed by varying the laser from maximum to minimum intensity in 16 equally spaced power intervals. Prints made to a resin-coated paper receiver were fused in acetone vapors at room temperature for 6 minutes.

Sensitometry

Sensitometric data were obtained using a calibrated X-Rite 310 Photographic Densitometer (X-Rite Co., Grandville, Mich.) from printed step targets. Status A red, green and blue transmission densities were read from transparent receivers while status A red, green and blue reflection densities were read from paper receivers and indirect receivers laminated to paper.

Results

Reflection densities, obtained from prints made with a multicolor dye-donor (E-1) and a single-color dye-donor as a reference (E-3) are compared as a function of laser power in Table I. Only the magenta beads in E-1 and E-3 contain the IR-1 dye, (the yellow beads in E-1 contain only image dye and binder). The donors were exposed with 816 nm radiation using the drum printer so that only the magenta record should print. Status A Green and Blue densities are reported for each donor at the laser powers indicated.

TABLE I

| | Reflection Density vs Laser Power | | | |
|---|---|---|---|---|
| | Multicolor Donor | | Single Color Reference Donor | |
| Power (mW) | E-1 Blue[a] | E-1 Green[b] | E-3 Blue[a] | E-3 Green[b] |
| 115 | 0.57 | 1.41 | 1.22 | 2.85 |
| 105 | 0.55 | 1.37 | 1.23 | 2.86 |
| 94 | 0.49 | 1.25 | 1.16 | 2.93 |
| 84 | 0.46 | 1.20 | 1.12 | 2.86 |
| 73 | 0.40 | 1.07 | 1.05 | 2.87 |
| 63 | 0.31 | 0.89 | 0.90 | 2.67 |
| 52 | 0.32 | 0.91 | 0.84 | 2.57 |
| 42 | 0.26 | 0.77 | 0.69 | 2.28 |
| 31 | 0.19 | 0.61 | 0.53 | 1.85 |
| 21 | 0.17 | 0.60 | 0.33 | 1.20 |
| 11 | 0.14 | 0.52 | 0.23 | 0.87 |
| 0 | 0.00 | 0.00 | 0.00 | 0.00 |

[a]unwanted absorption.
[b]wanted absorption.

The above results show that a good magenta color can be transferred from a multicolor dye-donor containing both yellow and magenta beads. The ratio of unwanted blue density to wanted green density is about the same in both the multicolor mixed bead case and the single color reference donor. Thus, little or no yellow color is transferred when only the magenta dye bead is sensitized to the laser wavelength. The lower Dmax density for the multicolor mixed bead donor compared to the corresponding single color reference donor results from the fact that, at matched total dye coverage, the multicolor donor has approximately half the number of magenta beads as does the single color reference donor. The linear dependence of transfer density with laser power shows that continuous tone images which maintain reasonable color separation throughout the scale can be achieved with these multicolor donors as well as with the single color reference donor.

D-max densities, obtained from reflection prints made with single color dye-donors and multicolor dye-donors are compared in Table II using the drum print engine and Table III using the flat bed print engine. Only one color bead in each coating example contains the IR-1 dye. The other color bead, when present, has only image dye and binder. The first row, in each set of three samples, represents a single color reference check for the "pure" color. The ratio of unwanted/wanted for these reference checks represents the minimum contamination of color expected. Major crosstalk components of unwanted absorption are underlined for easy comparison with the reference.

TABLE II

Dmax Status A Reflection Density Comparisons of Unwanted Absorption Using Drum Print Engine

| Example #. | Description of Beads | Wanted[a] D-max Density | Unwanted/Wanted[b] Red | Green | Blue |
|---|---|---|---|---|---|
| E-9 (reference) | C(IR-1) | 1.86 | — | 0.38 | 0.10 |
| E-8 | C(IR-1) + M | 1.36 | — | 0.58 | 0.17 |
| E-7 | C(IR-1) + Y | 1.18 | — | 0.39 | 0.48 |
| E-3 (reference) | M(IR-1) | 2.85 | 0.16 | — | 0.43 |
| E-6 | M(IR-1) + C | 1.55 | 0.39 | — | 0.29 |
| E-1 | M(IR-1) + Y | 1.41 | 0.09 | — | 0.40 |
| E-4 (reference) | Y(IR-1) | 2.26 | 0.01 | 0.07 | — |
| E-5 | Y(IR-1) + C | 1.70 | 0.32 | 0.13 | — |
| E-2 | Y(IR-1) + M | 1.50 | 0.03 | 0.24 | — |

[a]Dmax Status A Reflection density at the primary color of the dye-donor.
[b]Dmax density of unwanted color divided by the Dmax density at the primary color of the dye-donor.

TABLE III

Dmax Status A Reflection Density Comparisons of Unwanted Absorption Using Flat Bed Printer

| Example # | Description of Beads | Wanted[a] D-max Density | Unwanted/Wanted[b] Red | Green | Blue |
|---|---|---|---|---|---|
| E-9 (reference) | C(IR-1) | 1.61 | — | 0.57 | 0.31 |
| E-8 | C(IR-1) + M | 1.08 | — | 0.77 | 0.32 |
| E-7 | C(IR-1) + Y | 1.13 | — | 0.42 | 0.67 |
| E-3 (reference) | M(IR-1) | 1.77 | 0.31 | — | 0.62 |
| E-6 | M(IR-1) + C | 1.44 | 0.48 | — | 0.42 |
| E-1 | M(IR-1) + Y | 0.91 | 0.04 | — | 0.44 |
| E-4 (reference) | Y(IR-1) | 1.90 | 0.04 | 0.12 | — |
| E-5 | Y(IR-1) + C | 1.04 | 0.38 | 0.20 | — |
| E-2 | Y(IR-1) + M | 1.41 | 0.07 | 0.31 | — |

[a]Dmax Status A Reflection density at the primary color of the dye-donor.
[b]Dmax density of unwanted color divided by the Dmax density at the primary color of the dye-donor.

The results from both print engines indicate that "good" optical density (int he range of 1 to 2 o.d.) can be achieved from a multicolor donor in the desired spectral range with reasonable writing speed and laser power.

Some color contamination does occur when the multicolor donors are printed. Unwanted absorption increases by a factor of about 3 or less for all but the worst case. Cyan contamination on yellow transfers increases by about 10 to 30 times. Nevertheless, one color can indeed be printed from a dye-donor in the presence of a second color, while maintaining a reasonable level of color separation.

Results obtained by printing three-color donors at 633 nm (HeNe laser) and 830 nm (IR diode laser) are shown in Table IV. As in the previous examples, only one color bead contains the IR-1 dye, as indicated in the second column. Cyan dye has an intrinsic absorption at 633 nm and thus functions as both the image dye and the laser absorber.

TABLE IV

Reflection Density from Prints Using Three-Color Donors

| Example # | Description | 633 nm Red | Green | Blue | 830 nm Red | Green | Blue |
|---|---|---|---|---|---|---|---|
| E-10 | C + M(IR-1) + Y | 0.65[a] | 0.40 | 0.14 | 0.95 | 1.34[a] | 0.48 |
| E-11 | C + M + Y(IR-1) | 0.31[a] | 0.22 | 0.07 | 0.53 | 0.37 | 0.89[a] |

[a]Wanted absorptions are underlined; other entries are unwanted absorptions.

The data in Table IV clearly demonstrate that multicolor donors containing beads can produce different colors when exposed with different wavelengths. E-10 prints cyan with 633 nm and magenta with nm exposure. E-11 prints cyan with 633 nm and greenish-yellow with 830 nm.

E-12 Sincle Layer Mixed Beads: Cyan (IR-2) +Magenta (IR-1) +Yellow (IR-3)

A cyan bead dispersion was prepared as in E-5 except that 6.0 g of IR-2 (S101756 from ICI Corp.) was added. A magenta bead dispersion was prepared as in E-3. A yellow bead dispersion was prepared as in E-1, except that 6.0 g of IR-3 (Cyasorb® IR-165 from American Cyanamid Corp.) was added. A mixed bead dispersion was prepared by combining 1.28 g of the 32.7% solids cyan dispersion, 1.49 g of the 19.2% solids magenta dispersion, and 0.77 g of the 24.4% solids yellow dispersion. This mixed bead dispersion (3.5 g), 1.1 g gelatin (9.0%), 5.0 g of a 1% solution of Keltrol T® xanthan gum (Merck Co.) and 2.8 g of a solution of Dowfax 2Al® surfactant were diluted with 47.5 g of distilled water. The coating was applied as in E-1.

The results obtained for Status A red, green and blue density, from a 16 step test print using the three laser printer at 781 nm, 875 nm and 980 nm, respectively, are summarized in Table V.

TABLE V

| Steps | 781 nm R | G | B | 875 nm R | G | B | 980 nm R | G | B |
|---|---|---|---|---|---|---|---|---|---|
| 1 | 0.67 | 0.49 | 0.28 | 0.27 | 0.32 | 0.19 | 0.00 | 0.00 | 0.19 |
| 2 | 0.62 | 0.45 | 0.25 | 0.22 | 0.28 | 0.16 | 0.00 | 0.00 | 0.17 |
| 3 | 0.56 | 0.41 | 0.21 | 0.16 | 0.22 | 0.12 | 0.00 | 0.00 | 0.17 |
| 4 | 0.48 | 0.36 | 0.18 | 0.12 | 0.17 | 0.09 | 0.00 | 0.00 | 0.15 |
| 5 | 0.39 | 0.30 | 0.14 | 0.08 | 0.13 | 0.07 | 0.00 | 0.00 | 0.14 |
| 6 | 0.30 | 0.23 | 0.09 | 0.05 | 0.09 | 0.04 | 0.00 | 0.00 | 0.13 |
| 7 | 0.20 | 0.16 | 0.06 | 0.02 | 0.06 | 0.03 | 0.00 | 0.00 | 0.12 |
| 8 | 0.11 | 0.11 | 0.04 | 0.00 | 0.04 | 0.02 | 0.00 | 0.00 | 0.10 |
| 9 | 0.04 | 0.07 | 0.02 | 0.00 | 0.03 | 0.01 | 0.00 | 0.00 | 0.09 |
| 10 | 0.01 | 0.05 | 0.02 | 0.00 | 0.02 | 0.01 | 0.00 | 0.00 | 0.07 |
| 11 | 0.00 | 0.03 | 0.01 | 0.00 | 0.00 | 0.00 | 0.00 | 0.00 | 0.05 |
| 12 | 0.00 | 0.02 | 0.01 | 0.00 | 0.00 | 0.00 | 0.00 | 0.00 | 0.03 |
| 13 | 0.00 | 0.01 | 0.00 | 0.00 | 0.00 | 0.00 | 0.00 | 0.00 | 0.01 |
| 14 | 0.00 | 0.00 | 0.00 | 0.00 | 0.00 | 0.00 | 0.00 | 0.00 | 0.00 |
| 15 | 0.00 | 0.00 | 0.00 | 0.00 | 0.00 | 0.00 | 0.00 | 0.00 | 0.00 |
| 16 | 0.00 | 0.00 | 0.00 | 0.00 | 0.00 | 0.00 | 0.00 | 0.00 | 0.00 |

The above data show that a single dye-donor can be sensitized to three different IR wavelengths and can be selectively addressed to print different colors. With the 781 nm laser, the dye-donor printed a blue-gray color. With the 875 nm laser, a magenta-gray color was obtained. With the 980 nm laser, a pure yellow color was achieved. The variation of density over a useful range of laser powers shows that the dye-donor can print continuous tone. The lack of color saturation in this example is due primarily to the unwanted absorption of the IR dyes at wavelengths corresponding to the other color records and is not a fundamental limitation. Narrower absorption band IR dyes or more widely separated diode laser wavelengths would ameliorate this color saturation problem.

The invention has been described in detail with particular reference to preferred embodiments thereof, but it will be understood that variations and modifications can be effected within the spirit and scope of the invention.

What is claimed is:

1. A multicolor dye donor element for laser-induced thermal dye transfer comprising a support having thereon a single dye layer comprising a mixture of at least two different colors of solid, homogeneous beads, each of which contains an image dye, a binder and a laser light-absorbing material, said beads being dispersed in a vehicle, and said beads of each said color being sensitized to a different wavelength.

2. The element of claim 1 wherein said vehicle is gelatin.

3. The element of claim 1 wherein said binder is cellulose acetate propionate or nitrocellulose.

4. The element of claim 1 wherein said beads are approximately 0.1 to about 20 μm in size.

5. The element of claim 1 wherein said beads are employed at a concentration of about 40 to about by weight, based on the total coating weight of the bead-vehicle mixture.

6. The element of claim 1 wherein each said laser light-absorbing material is a dye.

7. A process of forming a multicolor laser-induced thermal dye transfer image comprising:

a) contacting a multicolor dye donor element comprising a support having thereon a single dye layer comprising a mixture of at least two different colors of solid, homogeneous beads, each of which contains an image dye, a binder and a laser light-absorbing material, said beads being dispersed in a vehicle, and said beads of each said color being sensitized to a different wavelength, with a dye-receiving element comprising a support having thereon a polymeric dye image-receiving layer;

b) imagewise-heating said dye-donor element by means of a laser; and c) transferring a dye image to said dye-receiving element to form said multicolor laser-induced thermal dye transfer image.

8. The process of claim 7 wherein said vehicle is gelatin.

9. The process of claim 7 wherein said binder is cellulose acetate propionate or nitrocellulose.

10. The process of claim 7 wherein said beads are approximately 0.1 to about 20 μm in size.

11. The process of claim 7 wherein said beads are employed at a concentration of about 40 to about 90% by weight, based on the total coating weight of the bead-vehicle mixture.

12. The process of claim 7 wherein each said laser light-absorbing material is a dye.

13. A thermal dye transfer assemblage comprising:

(a) a multicolor dye donor element for laser-induced thermal dye transfer comprising a support having thereon a single dye layer comprising a mixture of at least two different colors of solid, homogeneous beads, each of which contains an image dye, a binder and a laser light-absorbing material, said beads being dispersed in a vehicle, and said beads of each said color being sensitized to a different wavelength, and (b) a dye-receiving element comprising a support having thereon a dye image-receiving layer, said dye-receiving element being in superposed relationship with said dye-donor element so that said dye layer is in contact with said dye image-receiving layer.

14. The assemblage of claim 13 wherein said vehicle is gelatin.

15. The assemblage of claim 13 wherein said binder is cellulose acetate propionate or nitrocellulose.

16. The assemblage of claim 13 wherein said beads are approximately 0.1 to about 20 μm in size.

17. The assemblage of claim 13 wherein said beads are employed at a concentration of about 40 to about 90% by weight, based on the total coating weight of the bead-vehicle mixture.

18. The assemblage of claim 13 wherein each said laser light-absorbing material is a dye.

* * * * *

UNITED STATES PATENT AND TRADEMARK OFFICE

CERTIFICATE OF CORRECTION

PATENT NO.: 5,234,891

DATED: August 10, 1993

INVENTOR(S): Mitchell S. Burberry, John M. Noonan, Danny R. Thompson and Thomas A. Machell

It is certified that error appears in the above-identified patent and that said Letters Patent is hereby corrected as shown below:

Column 13, line 37, "about by" should read ---about 90% by---.

Signed and Sealed this

Fifteenth Day of March, 1994

*Attest:*

Bruce Lehman

BRUCE LEHMAN

*Attesting Officer*

*Commissioner of Patents and Trademarks*